US012145044B2

(12) United States Patent
Azaria et al.

(10) Patent No.: US 12,145,044 B2
(45) Date of Patent: Nov. 19, 2024

(54) EXERCISE MACHINE BOXING ENHANCEMENT

(71) Applicant: Tonal Systems, Inc., San Francisco, CA (US)

(72) Inventors: David Azaria, San Francisco, CA (US); Gert Petja, San Francisco, CA (US); Brandt Belson, San Francisco, CA (US)

(73) Assignee: Tonal Systems, Inc., San Francisco, CA (US)

( * ) Notice: Subject to any disclaimer, the term of this patent is extended or adjusted under 35 U.S.C. 154(b) by 218 days.

(21) Appl. No.: 17/870,615

(22) Filed: Jul. 21, 2022

(65) Prior Publication Data

US 2024/0024751 A1 Jan. 25, 2024

(51) Int. Cl.

| | |
|---|---|
| ***A63B 69/28*** | (2006.01) |
| ***A63B 24/00*** | (2006.01) |
| ***A63B 69/20*** | (2006.01) |
| ***A63B 69/24*** | (2006.01) |
| *A63B 71/06* | (2006.01) |

(52) U.S. Cl.

CPC ..... *A63B 69/28* (2022.08); *A63B 24/0062* (2013.01); *A63B 24/0075* (2013.01); *A63B 69/244* (2022.08); *A63B 69/305* (2022.08); *A63B 71/0622* (2013.01); *A63B 2071/063* (2013.01); *A63B 2220/17* (2013.01); *A63B 2225/093* (2013.01); *A63B 2244/102* (2013.01)

(58) Field of Classification Search

CPC . A63B 21/0059; A63B 21/156; A63B 21/169; A63B 24/0062; A63B 24/0075; A63B 69/20; A63B 69/215; A63B 69/22; A63B 69/222; A63B 69/224; A63B 69/24; A63B 69/244; A63B 69/26; A63B 69/30; A63B 69/305; A63B 69/32; A63B 69/322; A63B 69/325; A63B 71/0622; A63B 2071/063; A63B 2071/0636; A63B 2071/0638; A63B 2071/0655; A63B 2220/10; A63B 2220/17; A63B 2220/30; A63B 2220/40; A63B 2220/54; A63B 2220/62; A63B 2220/805; A63B 2220/806; A63B 2220/807; A63B 2225/093; A63B 2225/50; A63B 2244/102

See application file for complete search history.

(56) References Cited

U.S. PATENT DOCUMENTS

| | | | | | |
|---|---|---|---|---|---|
| 933,330 | A * | 9/1909 | Nevels | A63B 69/32 | 482/84 |
| 4,534,557 | A * | 8/1985 | Bigelow | A63B 69/32 | 482/84 |
| 5,733,193 | A * | 3/1998 | Allard | A63B 69/222 | 463/8 |

(Continued)

*Primary Examiner* — Joshua Lee

(74) *Attorney, Agent, or Firm* — Van Pelt, Yi & James LLP

(57) ABSTRACT

An exercise device comprises a motor, a boxing accessory, and a cable coupled between the boxing accessory and the motor. In one embodiment, a sensor is configured to determine telemetry data associated with at least one of the motor or the cable, wherein the telemetry data comprises at least one of the following: cable acceleration, cable velocity, and cable position. In one embodiment, an arm is coupled to the cable and the arm is configured to position the cable.

17 Claims, 10 Drawing Sheets

(56) References Cited

U.S. PATENT DOCUMENTS

| | | | | |
|---|---|---|---|---|
| 5,803,877 | A * | 9/1998 | Franey | A63B 69/32 482/83 |
| 8,777,819 | B1 * | 7/2014 | Quintana | A63B 69/305 482/83 |
| 10,814,172 | B1 * | 10/2020 | Ilfrey | A63B 23/035 |
| 11,596,846 | B2 * | 3/2023 | León, III | A63B 69/32 |
| 11,951,370 | B2 * | 4/2024 | Zittel | A63B 69/305 |
| 2007/0087912 | A1 * | 4/2007 | DeCologero | A63B 69/305 482/86 |
| 2017/0087435 | A1 * | 3/2017 | Jones | A63B 71/0622 |
| 2021/0008428 | A1 * | 1/2021 | León, III | A63B 69/32 |
| 2022/0176223 | A1 * | 6/2022 | Zittel | A63B 24/0062 |
| 2022/0395740 | A1 * | 12/2022 | Curry | A63B 69/20 |
| 2022/0401811 | A1 * | 12/2022 | Liu | A63B 69/333 |

* cited by examiner

Individual Strike Displacement
0
902
904
906
Time

Sensor Displacement
0
908
910
Time

EXERCISE MACHINE BOXING ENHANCEMENT

BACKGROUND OF THE INVENTION

Exercise improves an individual's health. Strength training, also referred to as resistance training or weight lifting, is an important part of any exercise routine. It promotes the building of muscle, the burning of fat, and improvement of a number of metabolic factors including insulin sensitivity and lipid levels. Many users seek a more efficient and safe method of strength training and/or exercise. Other forms of exercise besides strength training include aerobic exercise which promotes endurance and improves the cardiovascular and respiratory systems, and skilled exercise such as boxing which promotes endurance and improves hand-eye coordination and body awareness.

To better improve an individual's health, a strength training machine should be easily integrable with their home or office, which typically has limited physical space. To be efficient with physical space, power, and other resources, a strength training machine that can serve additional duty as an aerobic exercise machine and/or a skilled exercise machine like a boxing machine is an improvement in efficiency for the machine.

BRIEF DESCRIPTION OF THE DRAWINGS

Various embodiments of the invention are disclosed in the following detailed description and the accompanying drawings.

DETAILED DESCRIPTION

Figure 1:
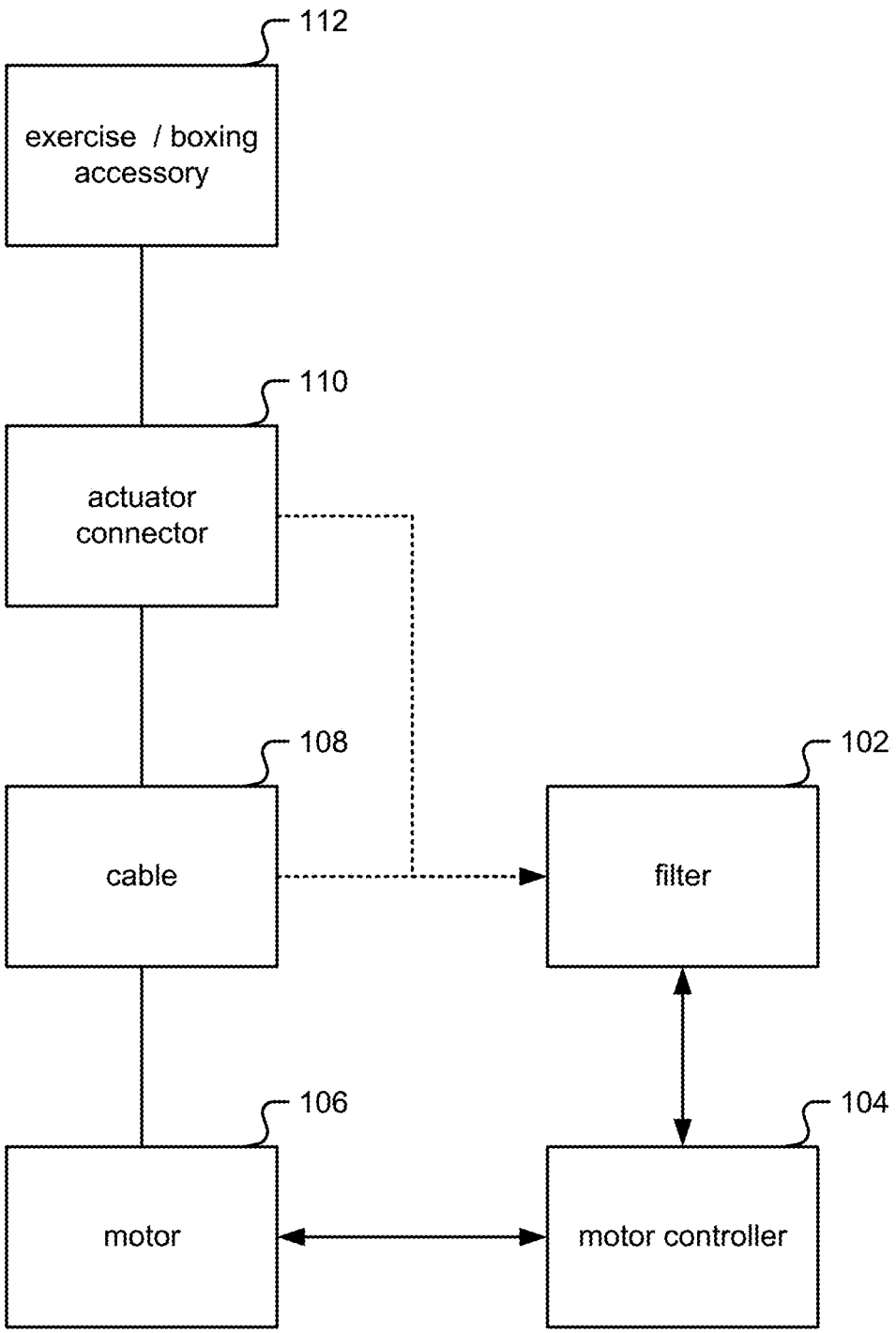
FIG. 1 is a block diagram illustrating an embodiment of an exercise machine capable of digital strength training.

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention. Unless stated otherwise, a component such as a processor or a memory described as being configured to perform a task may be implemented as a general component that is temporarily configured to perform the task at a given time or a specific component that is manufactured to perform the task. As used herein, the term 'processor' refers to one or more devices, circuits, and/or processing cores configured to process data, such as computer program instructions.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

Circuit training is one type of exercise/training comprising a variety of aerobic training, strength training, and exercises performed in a "circuit" of individual exercises, similar to high-intensity interval training. An improved circuit for circuit training involves boxing/punching bag training, such as speed bag training and heavy bag training. A speed bag or speedball is a mounted small inflated bag that rebounds after being struck with speed, requiring coordination and rhythm to hit the bag consecutively. Speed bag training develops skills, as punching a speed bag in a workout cadence requires a user's coordination, speed, and improves their cardiovascular system. A heavy bag is a mounted large bag filled with dense material, weighing approximately half the user's weight. Heavy bag training develops a user's strength, balance, and form as the user punches with resistance provided by the heavy bag.

An example of an improved circuit is one that includes bicep curls for two minutes, cardio kickboxing workout for two minutes, push-ups for two minutes, then a speed bag exercise for two minutes. An improved circuit training with a single machine is disclosed. The single machine may include a sensor and/or camera that determines the number of punches landed within the circuit, how hard punches are thrown within the circuit, form feedback included during the speed bag exercise, and aerobic health monitoring such as a heartrate monitor. In one embodiment, a boxing accessory comprises a marker visible to a camera. Another example of an improved training with the boxing accessory is a high-intensity interval training using a Tabata protocol with 20 seconds of intense exercise like repetitive speed bag punches, and 10 seconds of rest.

In one embodiment, the disclosed machine does not require special gloves like specialized boxing machines. The machine instead uses a sensor such as a cable sensor and/or camera to detect landed punch counts, landed punch strength, and form feedback. One example of form feedback is when the camera and/or sensor is used to determine a type of punch such as a jab, cross, hook, and/or uppercut, and based on the type of punch, boxing coaching may encourage better form for the respective type.

In one embodiment, the exercise machine provides a curriculum, wherein the curriculum comprises circuit training, and wherein providing the curriculum comprises at least one of the following: centralized storing of performance data pertaining to multiple exercises in the circuit; repetition-based boxing exercise interleaved with repetition-based strength training and/or repetition-based aerobic training; and speed training comprising a positioning arm associated with a boxing exercise and a second positioning arm associated with another exercise. For example, to make the setup of a circuit training set efficient, a first arm may be a speed bag station and a second arm may be a pull-up station.

The disclosed accessory may be used with exercise machines, including a machine where motor torque is associated with resistance, for example, using a digital strength training technique as described in U.S. Pat. No. 10,661,112 entitled DIGITAL STRENGTH TRAINING filed Jul. 20, 2017, and U.S. Pat. No. 10,335,626 entitled EXERCISE MACHINE WITH PANCAKE MOTOR filed Jul. 2, 2019, which are incorporated herein by reference for all purposes. Any person of ordinary skill in the art understands that the disclosed accessory may be used without limitation with other exercise apparatus, and the digital strength trainer is given merely as an example embodiment.

FIG. 1 is a block diagram illustrating an embodiment of an exercise machine capable of digital strength training. The exercise machine includes the following:

- a controller circuit (104), which may include a processor, inverter, pulse-width-modulator, and/or a Variable Frequency Drive (VFD);
- a motor (106), for example, a three-phase brushless DC driven by the controller circuit;
- a spool with a cable (108) wrapped around the spool and coupled to the spool. On the other end of the cable an actuator connector (110) is coupled in order to fit either an actuator/handle (112) for a user to grip and pull on or a boxing accessory (112). The spool is coupled to the motor (106) either directly or via a shaft/belt/chain/gear mechanism. Throughout this specification, a spool may also be referred to as a "hub";
- a filter (102), to digitally control the controller circuit (104) based on receiving information from the cable (108) and/or actuator connector (110);
- optionally (not shown in FIG. 1) a gearbox between the motor and spool. Gearboxes multiply torque and/or friction, divide speed, and/or split power to multiple spools. Without changing the fundamentals of digital strength training, a number of combinations of motor and gearbox may be used to achieve the same end result. A cable-pulley system may be used in place of a gearbox, and/or a dual motor may be used in place of a gearbox;
- one or more of the following sensors (not shown in FIG. 1): a position encoder; and/or a sensor to measure position of the actuator connector (110). Examples of position encoders include a hall effect shaft encoder, a grey-code encoder on the motor/spool/cable (108), an accelerometer in the actuator connector (110), optical sensors, cameras, position measurement sensors/methods built directly into the motor (106), and/or optical encoders. In one embodiment, an optical encoder is used with an encoding pattern that uses phase to determine direction associated with the low resolution encoder. Other options that measure back-EMF (back electromagnetic force) from the motor (106) in order to calculate position also exist;
- a motor power sensor; a sensor to measure voltage and/or current being consumed by the motor (106);
- a user tension sensor; a torque/tension/strain sensor and/or gauge to measure how much tension/force is being applied to the actuator connector (110) by the user by punching and/or pulling. In one embodiment, a tension sensor is built into the cable (108). Alternatively, a strain gauge is built into the motor mount holding the motor (106). As the user exerts force on the actuator connector (110), this translates into strain on the motor mount which is measured using a strain gauge in a Wheatstone bridge configuration. In another embodiment, the cable (108) is guided through a pulley coupled to a load cell. In another embodiment, a belt coupling the motor (106) and cable spool or gearbox (108) is guided through a pulley coupled to a load cell. In another embodiment, the resistance generated by the motor (106) is characterized based on the voltage, current, or frequency input to the motor.

In one embodiment, a three-phase brushless DC motor (106) is used with the following:

- a controller circuit (104) combined with a filter (102) comprising:
- a processor that runs software instructions;
- three pulse width modulators (PWMs), each with two channels, modulated at 20 kHz;
- six transistors in an H-Bridge configuration coupled to the three PWMs;
- optionally, two or three ADCs (Analog to Digital Converters) monitoring current on the H-Bridge; and/or
- optionally, two or three ADCs monitoring back-EMF voltage;
- the three-phase brushless DC motor (106), which may include a synchronous-type and/or asynchronous-type permanent magnet motor, such that:
- the motor (106) may be in an "out-runner configuration" as described below;
- the motor (106) may have a maximum torque output of at least 60 Nm and a maximum speed of at least 300 RPMs;
- optionally, with an encoder or other method to measure motor position;
- a cable (108) wrapped around the body of the motor (106) such that the entire motor (106) rotates, so the body of the motor is being used as a cable spool in one case. Thus, the motor (106) is directly coupled to a cable (108) spool. In one embodiment, the motor (106) is coupled to a cable spool via a shaft, gearbox, belt, and/or chain, allowing the diameter of the motor (106) and the diameter of the spool to be independent, as well as introducing a stage to add a set-up or step-down ratio if desired. Alternatively, the motor (106) is coupled to two spools with an apparatus in between to split or share the power between those two spools. Such an apparatus could include a differential gearbox, or a pulley configuration; and/or
- an actuator connector (110) for an actuator (112) such as a boxing accessory, handle, a bar, a strap, or other accessory connected directly, indirectly, or via a connector such as a carabiner to the cable (108).

In some embodiments, the controller circuit (102, 104) is programmed to drive the motor in a direction such that it draws the cable (108) towards the motor (106). The user exerts force on the actuator connector (110) coupled to the cable (108) against the direction of pull of the motor (106).

One purpose of this setup is to provide an experience to a user similar to using a traditional cable-based strength training machine, where the cable is attached to a weight stack being acted on by gravity. Rather than the user resisting the pull of gravity, they are instead resisting the pull of the motor (106).

Note that with a traditional cable-based strength training machine, a weight stack may be moving in two directions: away from the ground or towards the ground. When a user pulls with sufficient tension, the weight stack rises, and as that user reduces tension, gravity overpowers the user and the weight stack returns to the ground.

By contrast in a digital strength trainer, there is no actual weight stack. The notion of the weight stack is one modeled by the system. The physical embodiment is an actuator connector (110) coupled to a cable (108) coupled to a motor (106). A "weight moving" is instead translated into a motor rotating. As the circumference of the spool is known and how fast it is rotating is known, the linear motion of the cable may be calculated to provide an equivalency to the linear motion of a weight stack. Each rotation of the spool equals a linear motion of one circumference or $2\pi r$ for radius r. Likewise, torque of the motor (106) may be converted into linear force by multiplying it by radius r.

If the virtual/perceived "weight stack" is moving away from the ground, motor (106) rotates in one direction. If the "weight stack" is moving towards the ground, motor (106) rotates in the opposite direction. Note that the motor (106) is pulling towards the cable (108) onto the spool. If the cable (108) is unspooling, it is because a user has overpowered the motor (106). Thus, note a distinction between the direction the motor (106) is pulling, and the direction the motor (106) is actually turning.

If the controller circuit (102, 104) is set to drive the motor (106) with, for example, a constant torque in the direction that spools the cable, corresponding to the same direction as a weight stack being pulled towards the ground, then this translates to a specific force/tension on the cable (108) and actuator connector (110). Calling this force "Target Tension," this force may be calculated as a function of torque multiplied by the radius of the spool that the cable (108) is wrapped around, accounting for any additional stages such as gear boxes or belts that may affect the relationship between cable tension and torque. If a user exerts force on the actuator connector (110) with more force than the Target Tension, then that user overcomes the motor (106) and the cable (108) unspools moving towards that user, being the virtual equivalent of the weight stack rising. However, if that user applies less tension than the Target Tension, then the motor (106) overcomes the user and the cable (108) spools onto and moves towards the motor (106), being the virtual equivalent of the weight stack returning.

BLDC Motor. While many motors exist that run in thousands of revolutions per second, an application such as fitness equipment designed for strength training has different requirements and is by comparison a low speed, high torque type application suitable for a BLDC motor.

In one embodiment, a requirement of such a motor (106) is that a cable (108) wrapped around a spool of a given diameter, directly coupled to a motor (106), behaves like a 200 lbs weight stack, with the user pulling the cable at a maximum linear speed of 62 inches per second. A number of motor parameters may be calculated based on the diameter of the spool.

| User Requirements | | | | | | |
|---|---|---|---|---|---|---|
| Target Weight | 200 lbs | | | | | |
| Target Speed | 62 inches/sec | = | 1.5748 meters/sec | | | |
| **Requirements by Spool Size** | | | | | | |
| Diameter (inches) | 3 | 5 | 6 | 7 | 8 | 9 |
| RPM | 394.7159 | 236.82954 | 197.35795 | 169. 1639572 | 148.0184625 | 131.5719667 |
| Torque (Nm) | 67.79 | 112.9833333 | 135.58 | 158.1766667 | 180.7733333 | 203.37 |
| Circumference (inches) | 9.4245 | 15.7075 | 18.849 | 21.9905 | 25.132 | 28.2735 |

Thus, a motor with 67.79 Nm of force and a top speed of 395 RPM, coupled to a spool with a 3 inch diameter meets these requirements. 395 RPM is slower than most motors available, and 68 Nm is more torque than most motors on the market as well.

Hub motors are three-phase permanent magnet BLDC direct drive motors in an "out-runner" configuration: throughout this specification out-runner means that the permanent magnets are placed outside the stator rather than inside, as opposed to many motors which have a permanent magnet rotor placed on the inside of the stator as they are designed more for speed than for torque. Out-runners have the magnets on the outside, allowing for a larger magnet and pole count and are designed for torque over speed. Another way to describe an out-runner configuration is when the shaft is fixed and the body of the motor rotates.

Hub motors also tend to be "pancake style." As described herein, pancake motors are higher in diameter and lower in depth than most motors. Pancake style motors are advantageous for a wall mount, subfloor mount, and/or floor mount application where maintaining a low depth is desirable, such as a piece of fitness equipment to be mounted in a consumer's home or in an exercise facility/area. As described herein, a pancake motor is a motor that has a diameter higher than twice its depth. As described herein, a pancake motor is between and 60 centimeters in diameter, for example 22 centimeters in diameter, with a depth between 6 and 15 centimeters, for example a depth of 6.7 centimeters.

Motors may also be "direct drive," meaning that the motor does not incorporate or require a gear box stage. Many motors are inherently high speed low torque but incorporate an internal gearbox to gear down the motor to a lower speed with higher torque and may be called gear motors. Direct drive motors may be explicitly called as such to indicate that they are not gear motors.

If a motor does not exactly meet the requirements illustrated in the table above, the ratio between speed and torque may be adjusted by using gears or belts to adjust. A motor coupled to a 9" sprocket, coupled via a belt to a spool coupled to a 4.5" sprocket doubles the speed and halves the torque of the motor. Alternately, a 2:1 gear ratio may be used to accomplish the same thing. Likewise, the diameter of the spool may be adjusted to accomplish the same.

Alternately, a motor with 100× the speed and 100th the torque may also be used with a 100:1 gearbox. As such a gearbox also multiplies the friction and/or motor inertia by 100×, torque control schemes become challenging to design for fitness equipment/strength training applications. Friction may then dominate what a user experiences. In other applications friction may be present, but is low enough that it is compensated for, but when it becomes dominant, it is difficult to control for. For these reasons, direct control of motor speed and/or motor position as with BLDC motors is more appropriate for fitness equipment/strength training systems.

Figure 2:
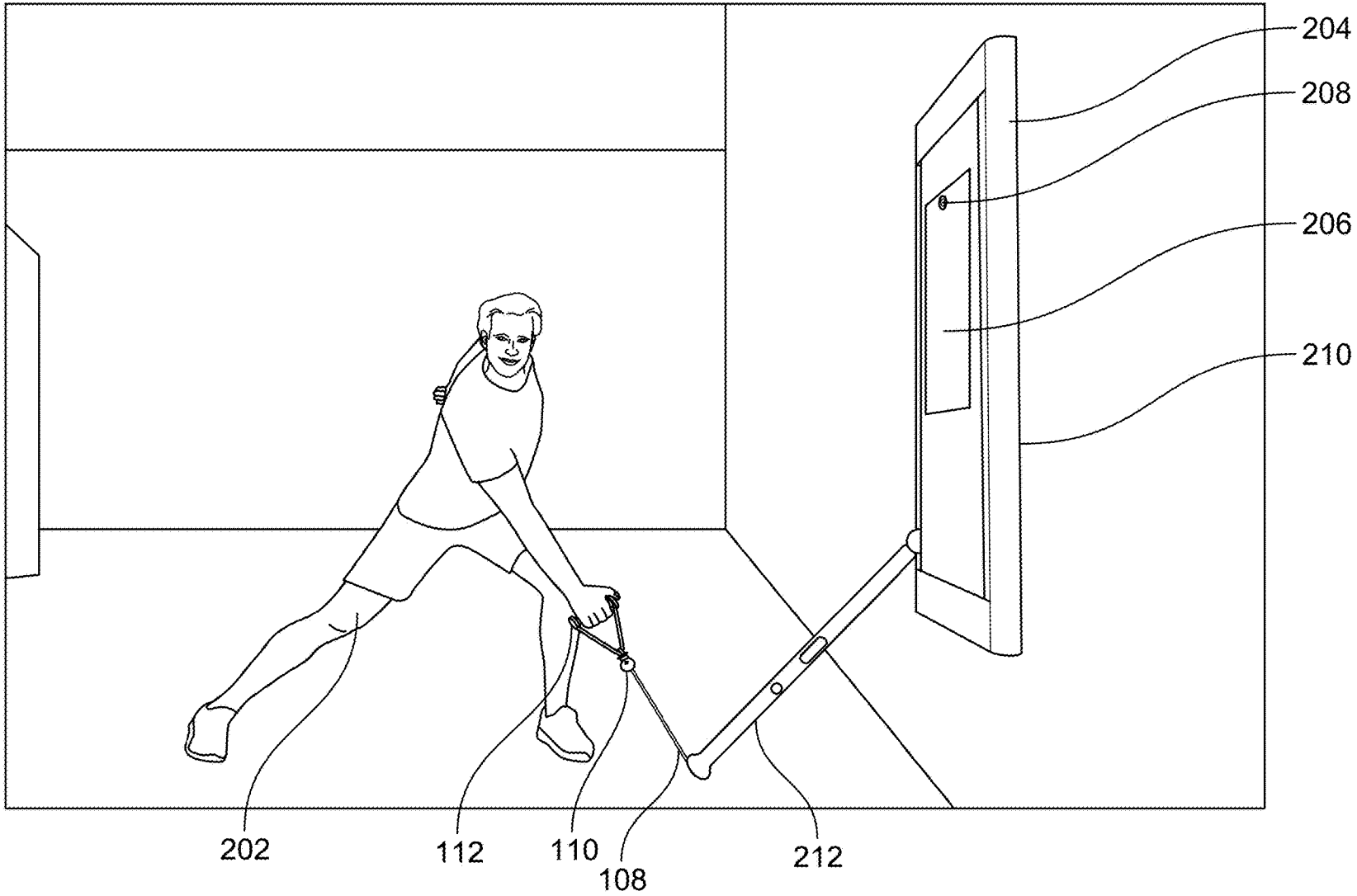
FIG. 2 is an illustration of a slim wall-hanging exercise machine platform in a sample use.

FIG. 2 is an illustration of a slim wall-hanging exercise machine platform in a sample use. In one embodiment, the machine of FIG. 1 is shown in illustrated form in FIG. 2. A user (202) is using the slim wall-hanging exercise machine (204), shown here in a portrait orientation, for a pull-up exercise with the video on the monitor (206) coaching the user.

Elements for a slim wall-hanging exercise machine platform (204) include at least one of the following:

- A motor controller such as that shown in FIG. 1 (104), connected to the motors enabling slow strength training, and fast cardiovascular exercise via filtering such as that shown in FIG. 1 (102);
- Firmware enabling AI coaching of exercises displayed on the monitor (206) and output on monitor speakers or other speakers/headsets;
- A monitor/screen (206) made of material that may serve as a mirror when unpowered, and as a touch screen capable of Internet apps and browsing when powered;
- A camera (208) to permit communication such as video conferencing e.g., for coaching, workout collaboration with other users, or form feedback used in conjunction with sensor fusion and/or computer vision. This form feedback may be used either where a user is fixed in frame and/or a user is fixed in position. As referred to herein, "sensor fusion" comprises fusion between telemetry data and camera data; a punch phase is determined at least in part using the camera; a recoil phase is determined at least in part using the camera; the camera is used at least in part to detect when a first punch lands; and the camera is used at least in part to count repetitions;
- Hardware (210) enabling the screen to pivot to landscape orientation for other exercise movements and/or entertainment; and/or
- Arms (212) and/or other cable positioning devices that position the cable (108) and/or where the user starts a workout in terms of the actuator (112). Illustrated in FIG. 2 are the cable (108), actuator connector (110), and actuator (112), in this case, a pull-up handle;

Multiple cameras in the disclosed machine or connected wirelessly in the room allow an artificial intelligence (AI) trainer, AI-assisted coach, and/or human coach depicted on the monitor (206) to have a better view of the user and provide better form detection. In one embodiment, the user is given a model of the perfect form visually overlaid with their own form to show areas of improvement or show the user alongside the fitness model or another user. The user is able to select the preferred viewing angle as there are multiple cameras.

As referred to herein, a "wall-hanging" machine is a machine that either hangs on a wall, is mounted on a stand, for example at a convenient height for sitting and/or standing, or is mounted in any way a traditional television or gaming device would be mounted. In one embodiment, a wall-hanging exercise machine is a universal or "ultimate" home exercise machine any user needs—and also serves as a wall hanging mirror, gaming portal, television screen, and home automation center.

A microphone system for voice commands may include multiple microphones to enable beamforming, far field control, and noise cancelling. In some cases the user environment may be quiet but for greater customer reliability this type of microphone supports noisy environments and cancels out any extraneous exercise equipment noise. The microphone system may be used to determine or assist determining when, for example, a speed bag and/or heavy bag is punched by the user and based on amplitude and phase, determines the relative strength with which a user hits a bag.

In one embodiment, the boxing accessory is part of a gamification of exercise to encourage more participation and engagement with a user. A collaboration mode progress with remote peers, real and/or historical, may be compared in order to encourage a user to try harder. A "ghost mode" may be used in conjunction with form feedback to show how a user has performed a punch such as an uppercut in the past on camera, and how it compares with a professional uppercut. A "virtual boxing match" may be made with a visual representation/score representation of how a user is doing with landing punches in comparison to a remote peer in order to spur competition between the user and the remote peer. In one embodiment, the "virtual boxing match" may comprise an optional haptic vest and/or haptic boxing glove accessory that allows the user to feel when a remote peer lands a punch.

Figure 3:
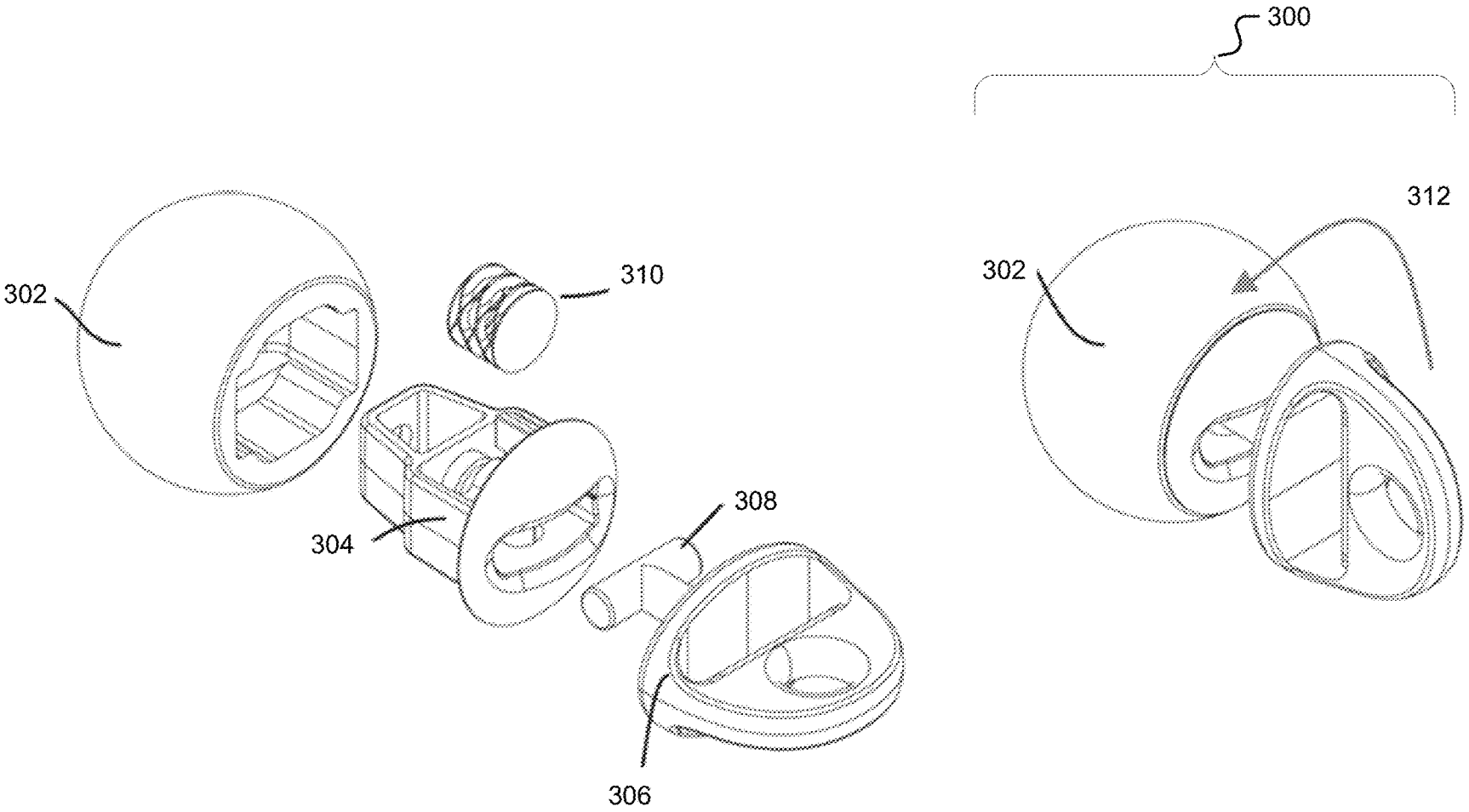
FIG. 3 illustrates an exploded view of an embodiment of a cable connection base.

FIG. 3 illustrates an exploded view of an embodiment of a cable connection base. In one embodiment, the cable connection base of FIG. 3 is shown as the actuator connector (110) in FIG. 1. Without limitation, other designs besides the specific one shown in FIG. 3 may be used to provide a quick release connection base using the principals shown in FIG. 3.

In one embodiment, an actuator connector frame (302) coupled to a cable (108) of FIG. 1 includes a cage (304) which provides an engagement point between a key (306) that includes a locking bar (308), and the frame (302). The cage (304) may include a biasing mechanism, such as a spring (310) to be positioned within the cage (304) right under the bar (308) when the bar is inserted. The spring (310) provides an elastic force to retain the locking bar (308) within the cage (304).

In one embodiment, the cage is fabricated with an appropriate détente position such that the key (306) only locks into the cage (304) when it is rotated 90 degrees clockwise, using a "push and turn to lock" paradigm (312). Thus, in the above configuration, the key may be unlocked if it is pushed in and turned 90 degrees counterclockwise (312).

In one embodiment, the diameter of locking bar (308) is in the range 3 mm to 30 mm. Further, the materials from which the cage (304) and key (306) may be made are from any rigid materials including, without limitation, steel, aluminum, high strength plastic, and carbon fiber. Moreover, cage (304) and key (306) may be manufactured using any manufacturing method, including, without limitation, injection molding, casting, machining, forging, and 3D printing.

In one embodiment (not shown), a cable may not be attached to the cable connection base (100). In the aforementioned configuration, the cage (112) and the ball (108) may be coupled together through an anchor. The anchor may retain the cage (112) to the body of the ball (108).

The quick release locking mechanism may be referred to herein as a "T-lock" connector (110) of FIG. 1 and/or (300) of FIG. 3. The quick release locking mechanism provides a safe and secure attachment point for connecting to user actuators such as a speed bag, heavy bag, carabiner, strap, handle, bar, dual handles, pull-down bar, and/or rope to perform various exercises. Enabling convenient detachment of these actuators from the cable connection base is an improvement for improved circuit training where different exercises within a circuit require different actuators and/or boxing accessories. Thus, a cable connection base that is easy and/or efficient for a user to attach and detach boxing accessories and/or actuators, yet safe to prevent sudden release, is an improvement.

Figure 4:
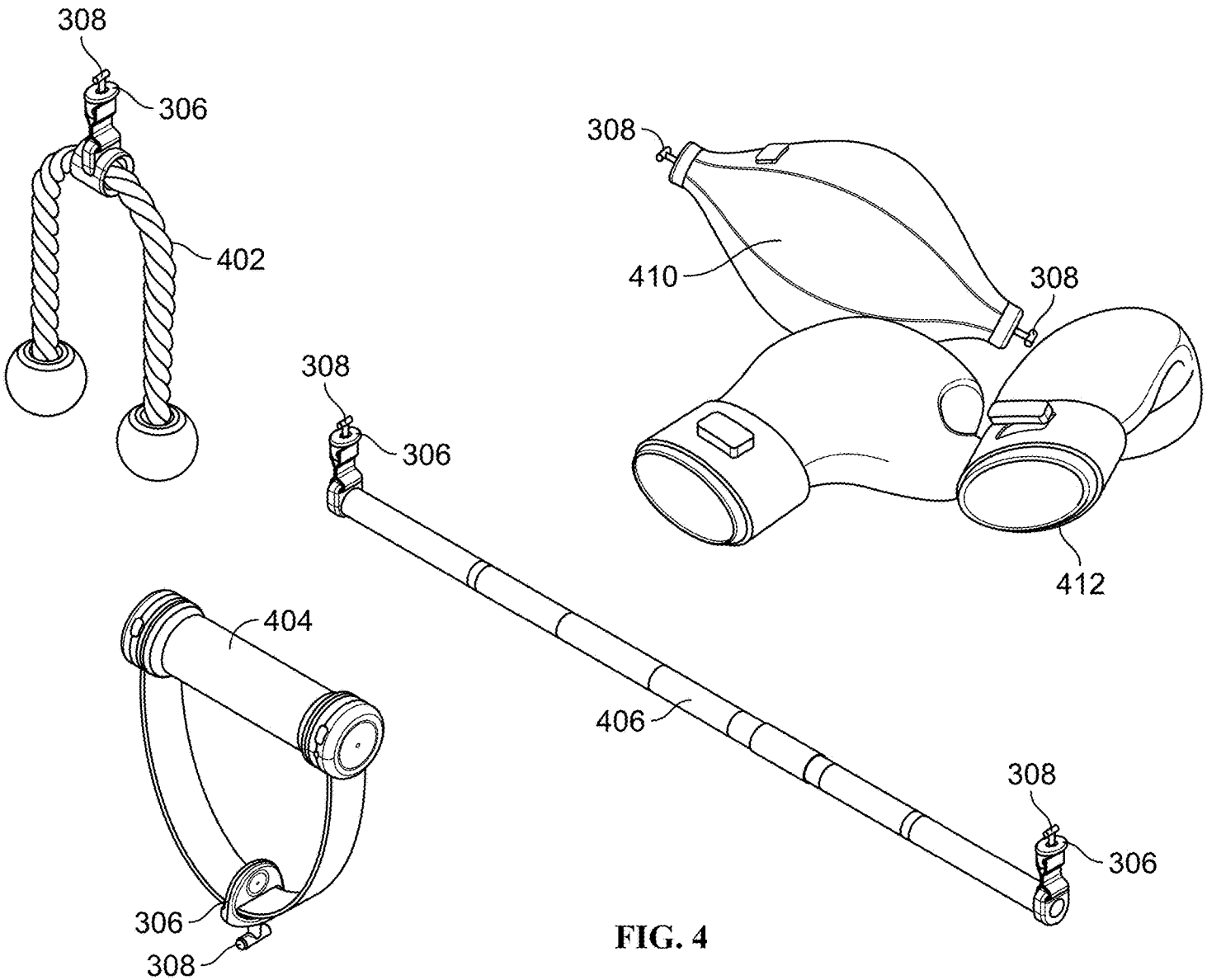
FIG. 4 illustrates three examples of an exercise actuator including their respective keys, and one example of a boxing accessory including its respective keys.

FIG. 4 illustrates three examples of an exercise actuator including their respective keys, and one example of a boxing accessory including its respective keys. In one embodiment, the four are examples of component (112) in FIG. 1.

Rope (402) includes a key (306), which itself includes a locking bar (308), similar to those shown in FIG. 3. The user would use the key (306) and locking bar (308) to efficiently and safely couple the rope (402) to a cable connection base/exercise machine as shown in FIG. 3 to be able to pull the rope for exercise, for example, for an exercise like a two-handed curl. Similarly, handle (404) also includes a key (306) and respective locking bar (308) for a user to couple to a cable connection base (110) and exercise machine. A handle may be useful for an exercise like a cable fly.

Bar (406) is a long actuator that may be used with two hands and itself has two keys (306), each with a lock bar (308). On a two-armed exercise machine, each of the two keys (306) may be used to connect to each arm (212) to provide a stable resistance with twice the resistance capacity, for example, 100 lb on each arm for 200 lb total. Such a bar (406) may be useful for an exercise like a lat pulldown.

In one embodiment, boxing accessory (410) uses the same quick release locking mechanism/T-lock mechanism for quick/safe connection. The example shown in FIG. 4 is a double-ended speed bag, but without limitation a heavy bag and/or single-ended speed bag may also use the quick release locking mechanism/T-lock mechanism for quick/safe connection. As shown in FIG. 4, the double-ended speed bag has two lock bars (308) to be connected between each arm (212). A single-ended speed bag (not shown) may have one lock bar (308) to be connected to one arm (212). A heavy bag (not shown) may have one or two lock bars (308) to be connected to both arms together (212).

Optionally, boxing gloves (412) may be used to improve the workout with greater hand protection and/or accuracy using a motion identifier. In one embodiment, the motion identifier comprises at least one of the following: an inertial measurement unit (IMU); a gyroscope; an accelerometer; a camera; a computer vision system; a microphone; and an audio analysis system.

The gloves (412) may be used to determine biosignals for a user, by including at least one of the following: a heart rate monitor; a pulse oximetry (SpO2/SaO2) monitor; an oxygen consumption (VO2 max) monitor; an electrocardiography (ECG) monitor; a blood pressure monitor; a pulse monitor; a brainwave monitor; a photoplethysmogram (PPG) monitor; an electromyography (EMG) monitor; an electrooculography (EOG) monitor; an electroencephalography (EEG) monitor; and/or a biosignal monitor.

Figure 5:
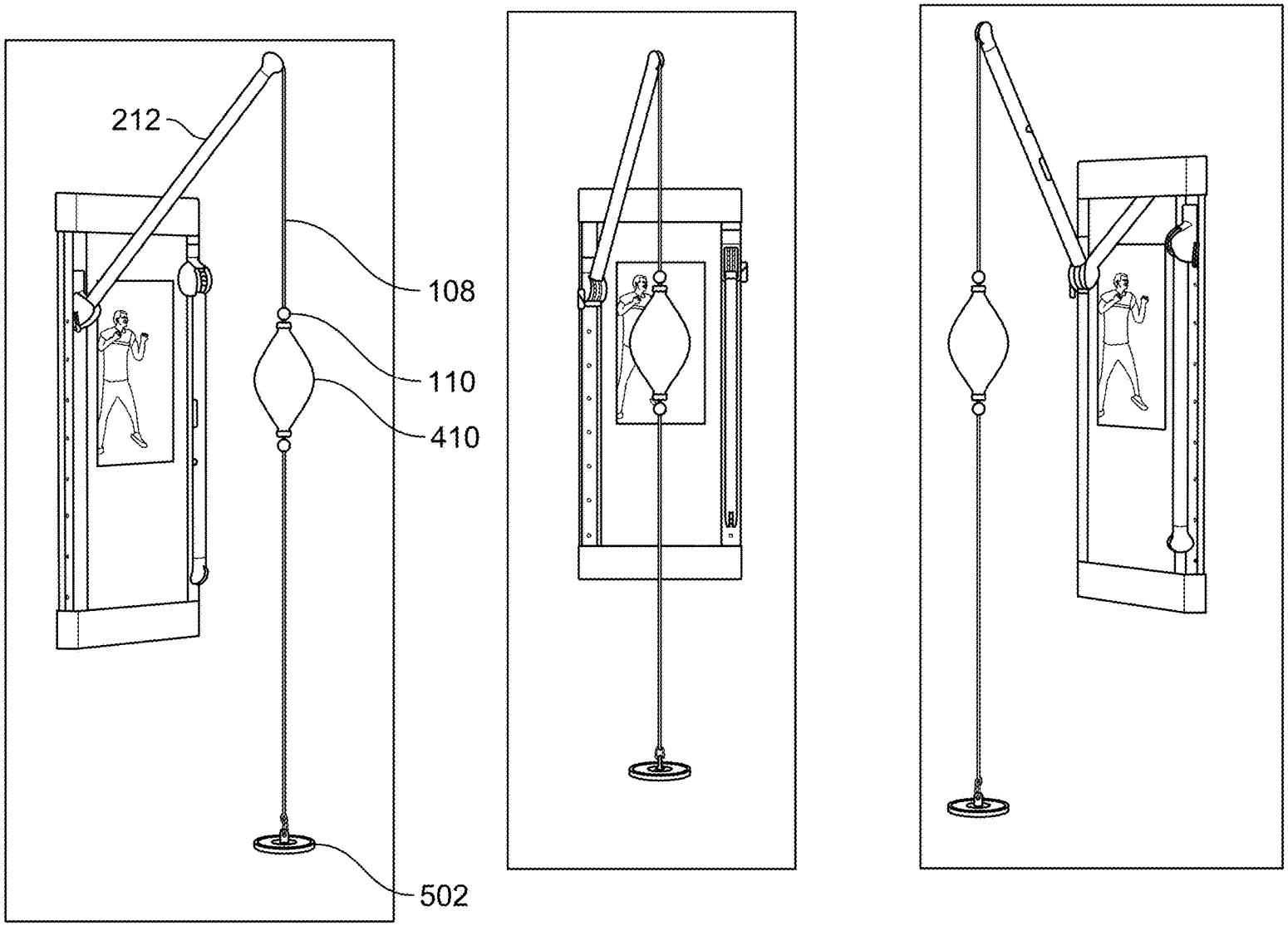
FIG. 5 is an illustration of a fixed-end speed bag as a boxing accessory with three perspectives.

FIG. 5 is an illustration of a fixed-end speed bag as a boxing accessory with three perspectives. In one embodiment, the exercise machines of FIGS. 1 and 2 are used for improved circuit training including a boxing element of the circuit.

The exercise machines of FIGS. 1 and 2 are used with arm (212) positioning cable (108) high and a floor mount (502). The cable connector (110) is used to connect to a boxing accessory such as a double-ended speed bag (410). In one embodiment, the (212) arm is adjustable and/or the cable (108) may be adjusted such that the height of the boxing accessory (410) is adjustable for a user's height and/or comfort. Without limitation, a (single-ended) speed bag (410) may be coupled in a similar manner, without the floor mount (502).

Figure 6:
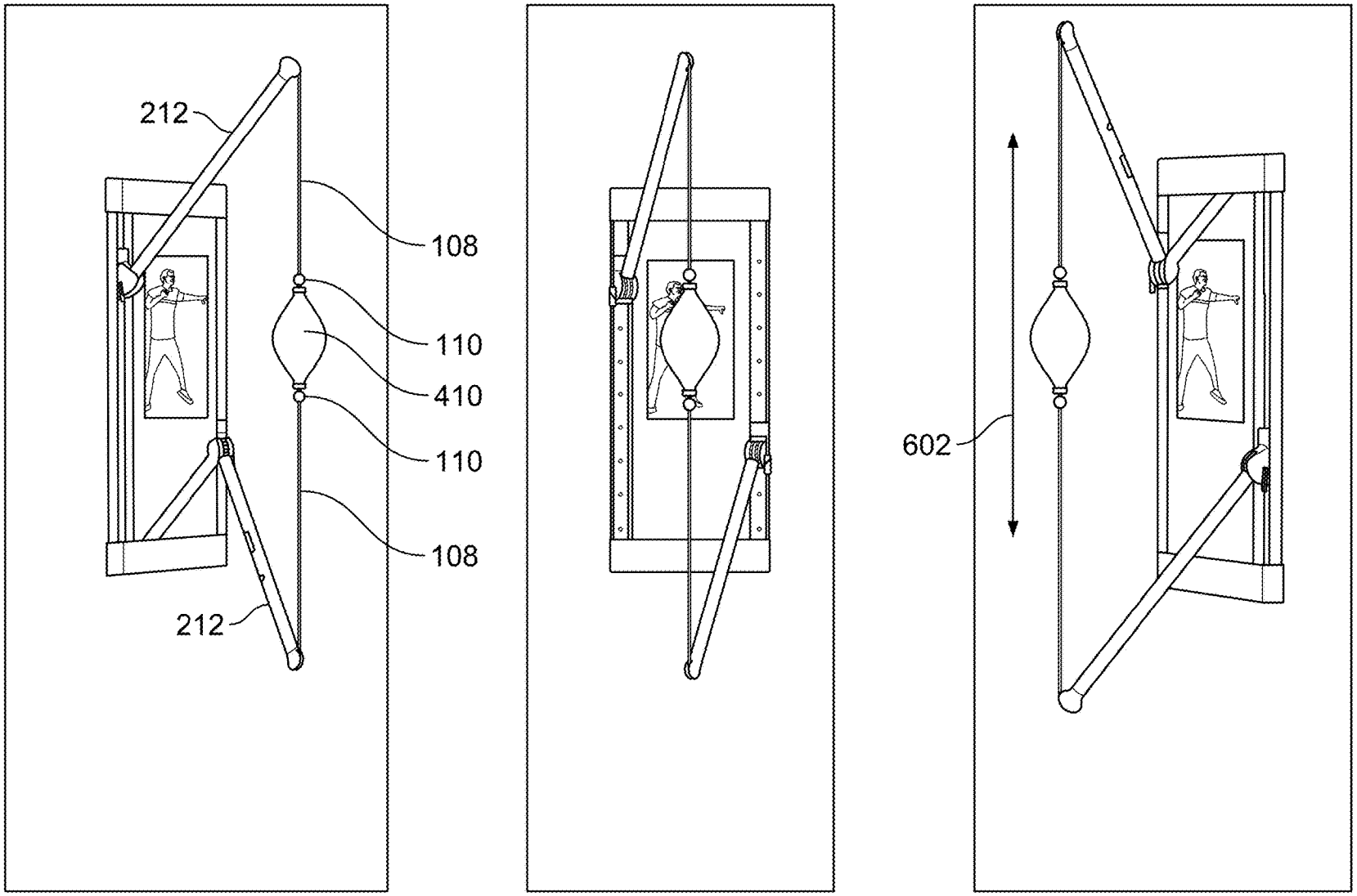
FIG. 6 is an illustration of a double-ended speed bag as a boxing accessory with three perspectives.

FIG. 6 is an illustration of a double-ended speed bag as a boxing accessory with three perspectives. In one embodiment, the exercise machines of FIGS. 1 and 2 are used for improved circuit training including a boxing element of the circuit.

The exercise machines of FIGS. 1 and 2 are used with a first arm (212) positioning its cable (108) high and above a second arm (212) positioning its cable (108) low. Both cable connectors (110) are used to connect to a boxing accessory such as a double-ended speed bag (410). In one embodiment, the first and second arms (212) are adjustable and/or the cables (108) may be adjusted such that the height of the boxing accessory (410) is adjustable for a user's height and/or comfort, and/or the tension of the boxing accessory (410) mounting is adjustable. For example, a virtual workout may involve punching a harder target with high tension, and a softer target with low tension, for example in a video gaming setting.

In one embodiment, a dual motor version of the exercise machines of FIGS. 1 and 2 is used, so that they may independently position their cable. By coordinating together, the double-ended speed bag (410) may be positioned up and down as shown in double-ended arrow (602). This allows for additional skill exercises and/or gaming such as a movement to land a punch on a moving target.

Figure 7:
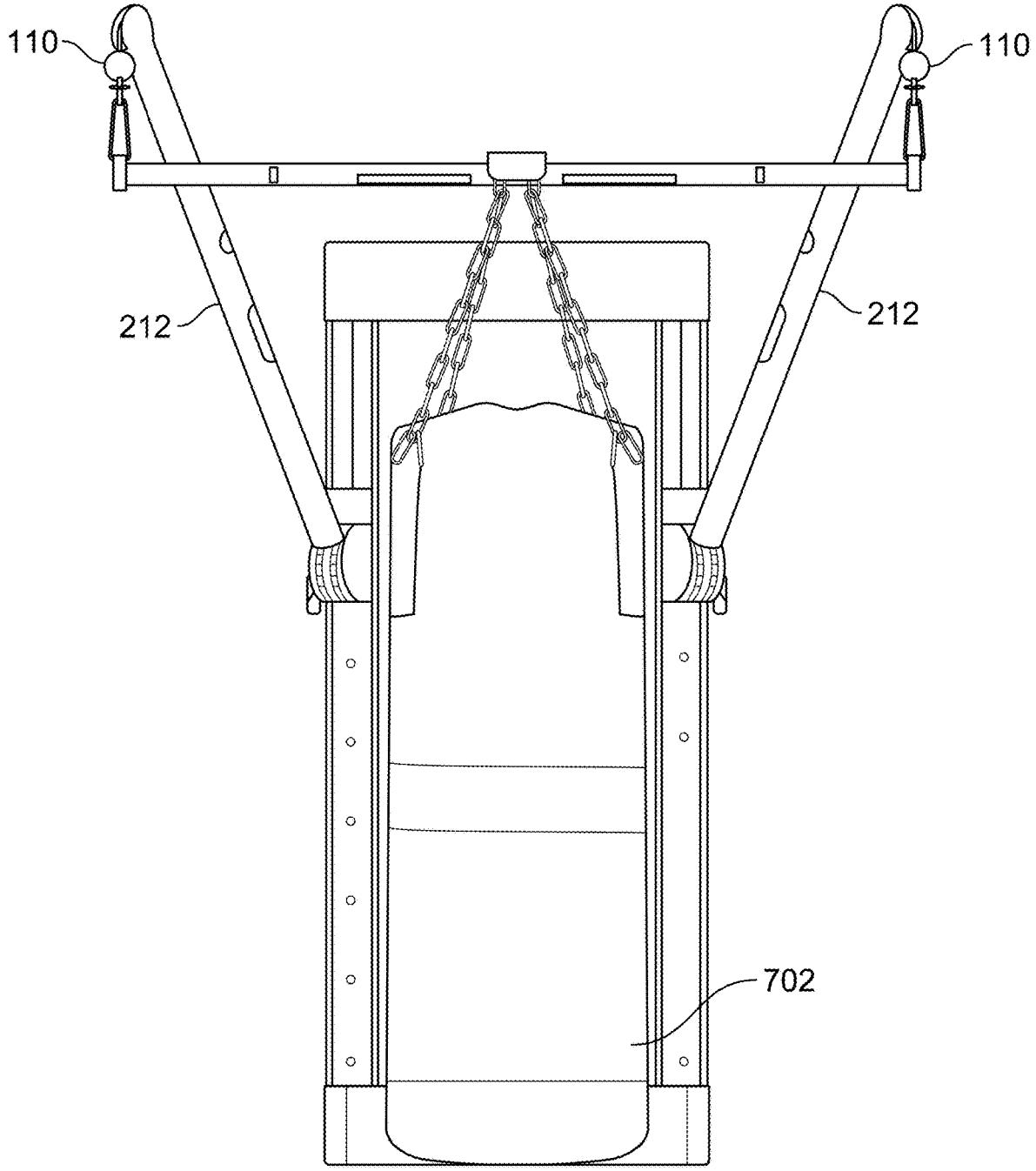
FIG. 7 is an illustration of a heavy bag as a boxing accessory.

FIG. 7 is an illustration of a heavy bag as a boxing accessory. In one embodiment, the exercise machines of FIGS. 1 and 2 are used for improved circuit training including a boxing element of the circuit.

The exercise machines of FIGS. 1 and 2 are used with a first arm (212) and second arm (212) positioning both cables high. Both cable connectors (110) are used to connect to a boxing accessory such as a heavy bag (702). The configuration shown in FIG. 7 is merely illustrative and the heavy bag may be mounted more directly to the two arms without the intermediate bar shown in FIG. 7.

Strike Data. Using sensors such as a cable sensor, motor sensor, and/or camera to detect landed punch counts, landed punch strength, and form feedback is disclosed. In one embodiment, a sensor may be used as shown in the following examples without limitation in FIGS. 8A, 8B, 9A, 9B, and 10.

Figure 8A:
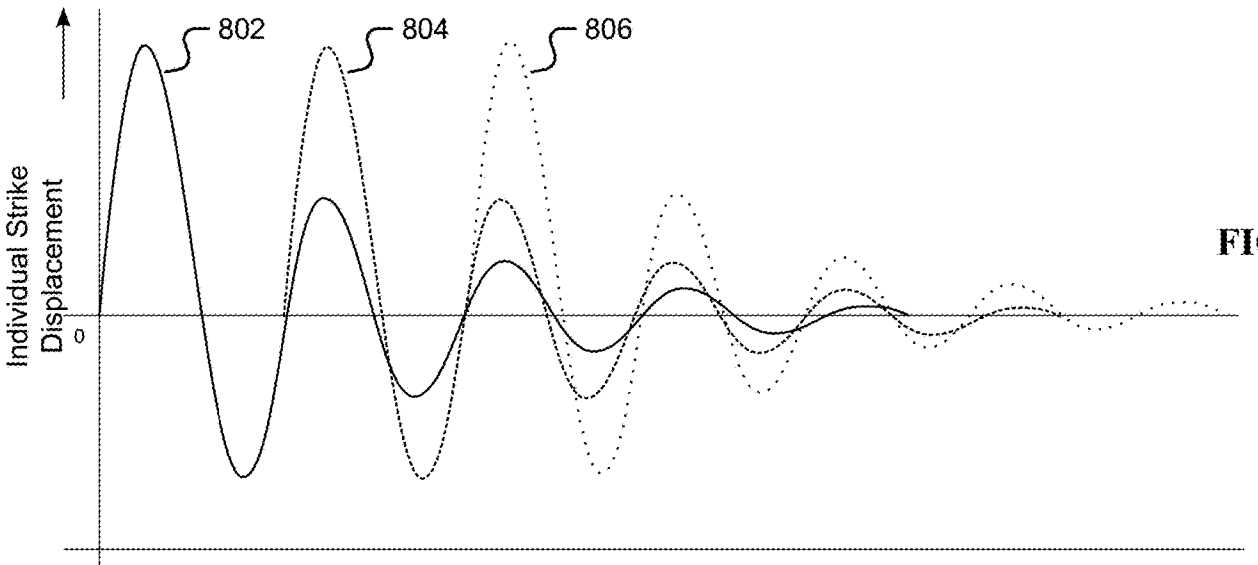
FIGS. 8A and 8B are illustrations of a series of initial boxing strike displacements from a user punching a boxing accessory.
Figure 8B:
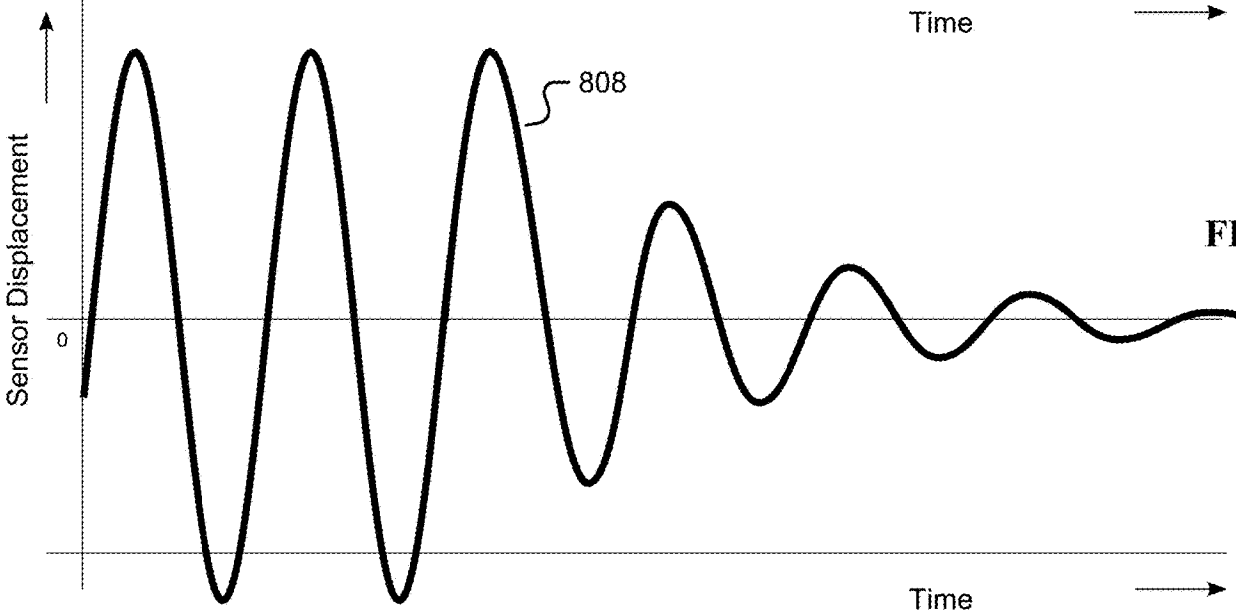

FIGS. 8A and 8B are illustrations of a series of initial boxing strike displacements from a user punching a boxing accessory. In one embodiment, the user is punching a boxing accessory like a speed bag and/or a heavy bag as shown in FIGS. 5-7.

In the illustration, a strike waveform is shown where the horizontal axis is time and the vertical axis is the amplitude of displacement along the cable (108) of FIG. 1 sensed by, for example, a cable sensor. Without limitation, a sensor may sense cable velocity and/or cable acceleration instead of, or along with, displacement.

In one embodiment, the machine of FIG. 1 comprises a sensor configured to determine telemetry data associated with at least one of the motor (106) or the cable (108), wherein telemetry data comprises at least one of the following: cable acceleration, cable velocity, and cable position. The sensor may comprise a motor encoder, wherein the motor encoder determines cable position, velocity, or acceleration.

In one embodiment, a processor either within the machine of FIGS. 1 and/or 2 or coupled via a network connection may be configured to determine user performance with respect to the boxing accessory (410) based on the telemetry data associated with the motor (106) or cable (108). Examples of user performance include: cable position change, cable velocity change, cable acceleration change; a swinging indicator; an acceleration profile; an expected bag acceleration; a punch repetition count; a count of landed punches; timing of landed punches; frequency of landed punches; period of landed punches; a count of partial hits; a count of direct hits; a count of misses; a count of swings; a count of initial swings; a count of second swings; a count of third swings; a count of harder punches; a count of bag swings; and/or an indication of health based at least in part on biosignal data. In one embodiment, determining user performance comprises collecting sensor measurements for a motor encoder or a cable encoder.

As shown in FIG. 8A, a first strike (802) would produce a displacement waveform, here shown as a thin solid line, that dampens over time as the bag gets hit and oscillates. Without limitation, a heavy bag may have less or no oscillation before being damped completely. Similarly, a second strike (804) and a third strike (806) would each produce a displacement waveform, here shown as a dashed line and a dotted line respectively.

As shown in FIG. 8B, these strikes are sensed in an aggregate manner (808) that, in the event a user is landing punches at an appropriate cadence, for example the resonant frequency of the swing of a speed bag (410), will provide a continuous and/or harmonious waveform (808) as shown in FIG. 8B. Thus, the cable sensor may detect when a user is landing punches on the speed bag with appropriate timing. The cable sensor may also determine the strength of the hit by measuring the amplitude of the waveform (808).

Figures 9A, 9B:
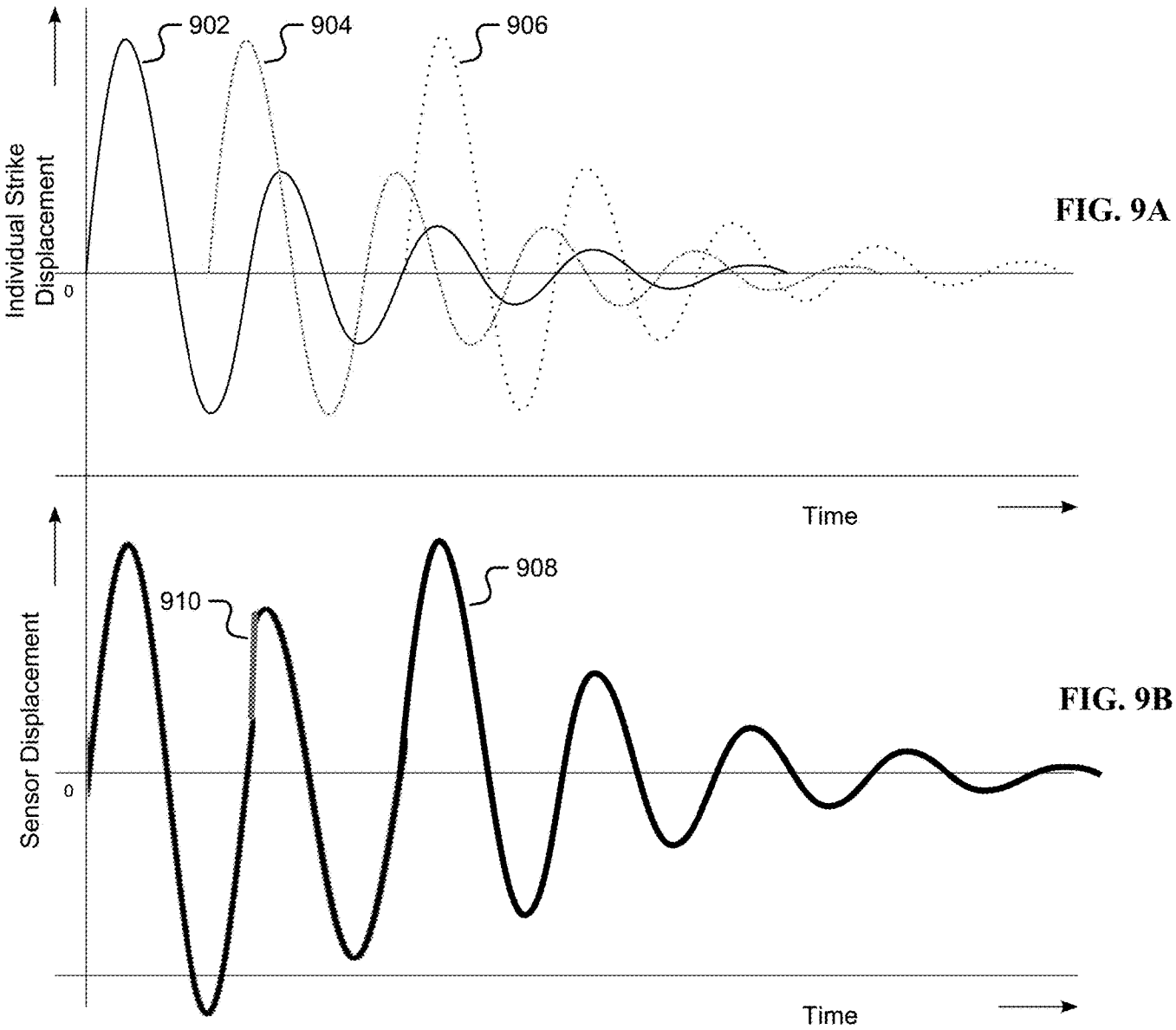
FIGS. 9A and 9B are illustrations of a missed strike from a user punching a boxing accessory.

FIGS. 9A and 9B are illustrations of a missed strike from a user punching a boxing accessory. In one embodiment, the user is punching a boxing accessory like a speed bag and/or a heavy bag as shown in FIGS. 5-7.

Similar to that shown in FIGS. 8A and 8B, a strike waveform is shown where the horizontal axis is time and the vertical axis is the amplitude of displacement along the cable (108) of FIG. 1 that is sensed by, for example, a cable sensor. Without limitation, a sensor may sense cable velocity and/or cable acceleration instead of, or along with, displacement.

As shown in FIG. 9A, a first strike (902) as a thin solid line is similar to a first strike (802) shown in FIG. 8A. However, the user does not connect immediately with second strike (904) shown as a dashed line and it is delayed in time, and the user also is thus delayed with their third strike (906), shown as a dotted line.

As shown in FIG. 9B, these strikes are sensed in an aggregate manner (908) that shows a discontinuity (910) with the delayed punch. This discontinuity may be detected by way of its frequency content and/or other waveform analysis techniques. Thus, the cable sensor may detect when a user is missing punches and/or delaying punches on the speed bag.

Figure 10:
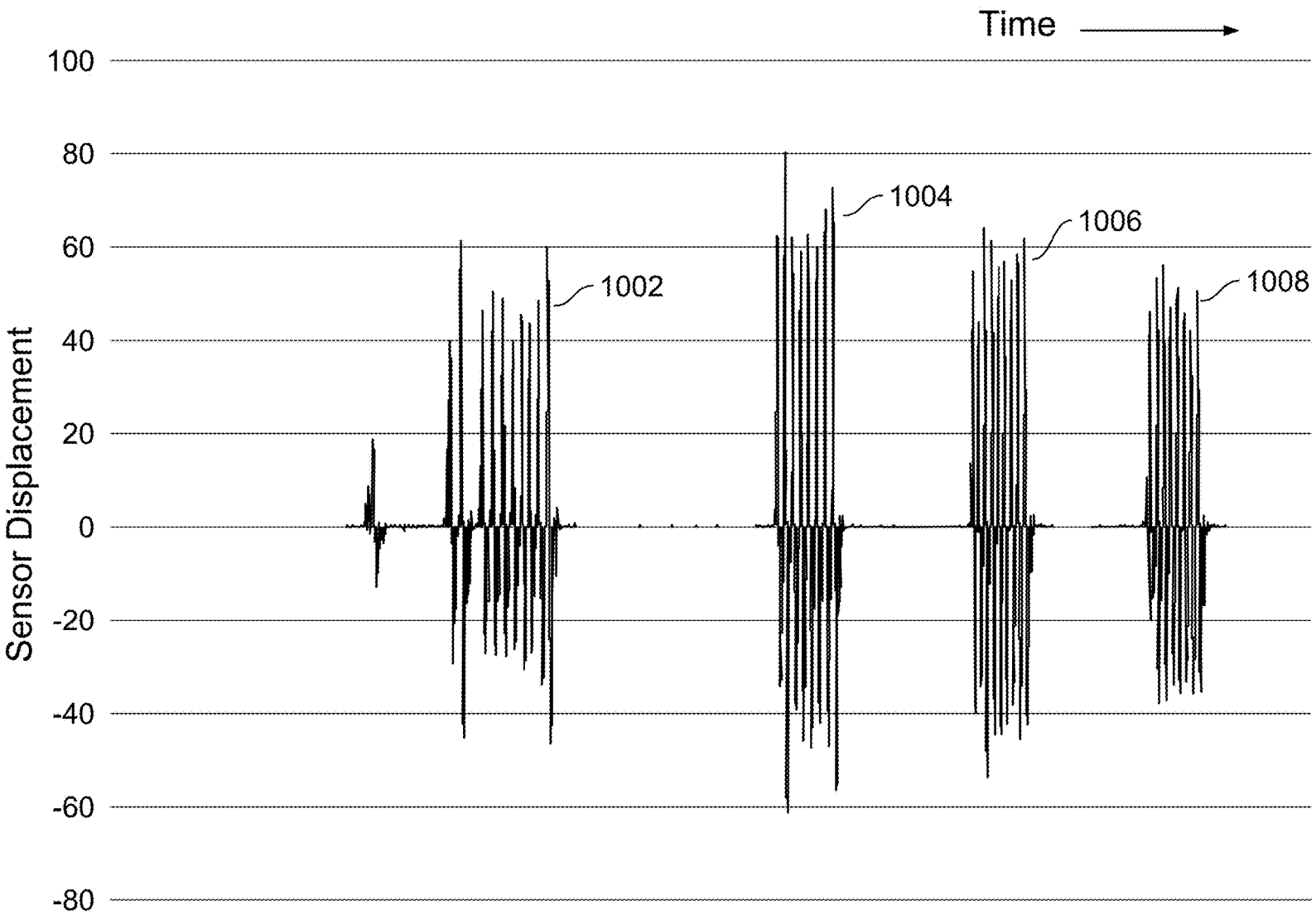
FIG. 10 is an illustration of a series of boxing strike displacements from a user punching a boxing accessory.

FIG. 10 is an illustration of a series of boxing strike displacements from a user punching a boxing accessory. In one embodiment, the user is punching a boxing accessory like a speed bag and/or a heavy bag as shown in FIGS. 5-7.

In the illustration, a strike waveform is shown where the horizontal axis is time and the vertical axis is the amplitude of displacement along the cable (108) of FIG. 1 that is sensed by, for example, a cable sensor. Without limitation, a sensor may sense cable velocity and/or cable acceleration instead of, or along with, displacement.

In one embodiment, the machine of FIG. 1 comprises a sensor configured to determine telemetry data associated with at least one of the motor (106) or the cable (108), wherein telemetry data comprises at least one of the following: cable acceleration, cable velocity, and cable position. The sensor may comprise a motor encoder, wherein the motor encoder determines cable position, velocity, or acceleration.

In one embodiment, a processor either within the machine of FIGS. 1 and/or 2 or coupled via a network connection may be configured to determine user performance with respect to the boxing accessory (410) based on the telemetry data associated with the motor (106) or cable (108). Examples of user performance include: cable position change, cable velocity change, cable acceleration change; a swinging indicator; an acceleration profile; an expected bag acceleration; a punch repetition count; a count of landed punches; timing of landed punches; frequency of landed punches; period of landed punches; a count of partial hits; a count of direct hits; a count of misses; a count of swings; a count of initial swings; a count of second swings; a count of third swings; a count of harder punches; a count of bag swings; and/or an indication of health based at least in part on biosignal data. In one embodiment, determining user performance comprises collecting sensor measurements for a motor encoder or a cable encoder.

As shown in FIG. 10, each strike may produce a subwaveform (1002), (1004), (1006), (1008) such as a displacement waveform. For example when the user hits a heavy bag, actuator and/or cable displacement may dampen over time as the bag gets hit and oscillates.

As shown in FIG. 10, these strikes may be sensed in discrete subwaveforms, are sensed in an aggregate manner (808) that, in the event a user is landing punches at an appropriate cadence, for example the resonant frequency of the swing of a speed bag (410), will provide a continuous and/or harmonious waveform (808) as shown in FIG. 8B. Thus, the cable sensor may detect when a user is landing punches on the speed bag with appropriate timing. The cable sensor may also determine the strength of the hit by measuring the amplitude of the waveform (808).

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. An exercise device, comprising:

a motor;

a boxing accessory;

a cable coupled between the boxing accessory and the motor;

an arm coupled to the cable, wherein the arm is configured to position the cable;

a second motor;

a second cable coupled between the boxing accessory and the second motor; and a second arm coupled to the second cable and wherein the second arm is configured to position the second cable.

2. The exercise device of claim 1, further comprising a sensor configured to determine telemetry data associated with at least one of the motor or the cable.

3. The exercise device of claim 1, further comprising a sensor configured to determine telemetry data associated with at least one of the motor or the cable, wherein the telemetry data comprises at least one of the following: cable acceleration, cable velocity, and cable position.

4. The exercise device of claim 1, wherein the boxing accessory is mounted by the arm using a quick release locking mechanism.

5. The exercise device of claim 1, wherein the boxing accessory is mounted between the arm and a floor mount.

6. The exercise device of claim 1, wherein the arm is adjustable such that the boxing accessory's height is adjustable.

7. The exercise device of claim 1, wherein the boxing accessory is mounted between the arm and the second arm, and wherein the boxing accessory is a double-ended bag, and wherein the motor is configured to adjust tension for the double-ended bag.

8. The exercise device of claim 1, wherein the boxing accessory is mounted by both the arm and the second arm, wherein the boxing accessory is a heavy bag, and wherein the motor is configured to hold the heavy bag up.

9. The exercise device of claim 1, further comprising:

a sensor configured to determine telemetry data associated with at least one of the motor or the cable; and a processor configured to determine user performance with respect to the boxing accessory based on the telemetry data.

10. The exercise device of claim 9, wherein the sensor comprises a motor encoder, wherein the motor encoder determines cable position, velocity, or acceleration.

11. The exercise device of claim 9, wherein the user performance comprises at least one of the following: cable position change, cable velocity change, cable acceleration change, a swinging indicator, an acceleration profile, an expected bag acceleration, a punch repetition count, a count of landed punches, a count of partial hits, a count of direct hits, a count of misses, a count of swings, a count of initial swings, a count of second swings, a count of third swings, a count of harder punches, and a count of bag swings.

12. The exercise device of claim 9, wherein determining the user performance comprises collecting sensor measurements for a motor encoder or a cable encoder.

13. The exercise device of claim 9, wherein the processor is further configured to provide a curriculum, wherein the curriculum comprises circuit training, and wherein providing the curriculum comprises at least one of the following: centralized storing of performance data pertaining to multiple exercises in circuit; repetition-based boxing exercise interleaved with repetition-based strength training; and speed training comprising a positioning arm associated with a boxing exercise and a second positioning arm associated with another exercise.

14. The exercise device of claim 9, further comprising a camera coupled to the processor, wherein the processor is further configured to provide a form feedback, and wherein: a user is fixed in frame, and a user is fixed in position.

15. The exercise device of claim 9, further comprising a camera coupled to the processor, wherein the processor is further configured to provide a sensor fusion, and wherein: the sensor fusion comprises fusion between the telemetry data and camera data; a phase is determined at least in part using the camera; a recoil phase is determined at least in part using the camera; the camera is used at least in part to detect when a first punch lands; and the camera is used at least in part to count repetitions.

16. The exercise device of claim 9, further comprising a camera coupled to the processor, wherein the boxing accessory comprises a marker visible to the camera.

17. The exercise device of claim 1, wherein the motor and the second motor are configured to move the boxing accessory up and down as a moving target.

* * * * *